United States Patent [19]

Bouillot et al.

[11] Patent Number: 5,025,241

[45] Date of Patent: Jun. 18, 1991

[54] TRANSFORMER OF FERRITE CLOSED MAGNETIC CIRCUIT TYPE

[75] Inventors: Jean-Michel Bouillot, Arc les Gray; Thierry Coutureau, Dole; Patrick G. Decuyper, Dijon, all of France

[73] Assignee: Orega Electronique et Mecanique, Courbevoie, France

[21] Appl. No.: 480,763

[22] Filed: Feb. 16, 1990

[30] Foreign Application Priority Data

Mar. 28, 1989 [FR] France ..... 89 03985

[51] Int. Cl.[5] ..... H01F 17/06; H01F 27/26

[52] U.S. Cl. ..... 336/100; 336/178; 336/219

[58] Field of Search ..... 336/178, 179, 165, 134, 336/100, 219, 210, 212

[56] References Cited

U.S. PATENT DOCUMENTS 2,554,262 5/1951 Nagel ..... 336/219 X
2,937,352 5/1960 Vienneau et al. ..... 336/219 X
3,028,570 4/1962 Taylor ..... 336/179 X
3,195,086 7/1965 Taylor ..... 336/179 X

FOREIGN PATENT DOCUMENTS 202284 3/1956 Australia ..... 336/178
2927182 1/1981 Fed. Rep. of Germany .
2500679 8/1982 France .

OTHER PUBLICATIONS

Insulation/Circuits, Directory/Encyclopedia Issue, Jun./Jul. 1972, pp. 122–128.

*Primary Examiner*—Thomas J. Kozma
*Attorney, Agent, or Firm*—Oblon, Spivak, McClelland, Maier & Neustadt

[57] ABSTRACT

The present invention concerns a transformer of the ferrite closed magnetic circuit type, with a gap.

The gap is filled with a mastic such as the polysulphide or polyurethane mastics having a Shore hardness with constant behaviour as a function of temperature.

3 Claims, 1 Drawing Sheet

TRANSFORMER OF FERRITE CLOSED MAGNETIC CIRCUIT TYPE

BACKGROUND OF THE INVENTION

1. Field of the invention

The present invention concerns a transformer with a closed ferrite magnetic circuit including an air gap, in particular a transformer of this type used in switching power supplies.

2. Description of the Prior Art switching power supplies operating in accumulation or flyback mode require energy storage in the ferrite magnetic circuit of a transformer before this energy is transferred to the electric circuit connected to the transformer. This energy storage requires the use of a magnetic circuit with an air gap. Conventionally, a type of transformer for switching power supply is constituted of a magnetic circuit composed of two half-circuits of ferrite having a section in the form of an "E" and winding support carrying one or more electrically separated coils. The winding support is provided with an axial hole in which are inserted the central arms of the "E"s. The magnetic circuit and the winding support are assembled by glueing. One of the ferrite half-circuits is preferably stuck to the winding frame, then the two magnetic half-circuit are joined by sticking together the sides facing the outer arms of the circuits. This leaves an air gap between the inner arms. Such an assembly guarantees good mechanical strength of the magnetic circuit and the coil. The air gap easily absorbs mechanical stresses, provoked in particular by thermal shocks, in conformity with present norms. However, when the gap is an air gap, it generates magnetostrictive phenomena which induce audible humming in the transformer. Magnetostriction is a type of elastic deformation related to magnetism, i.e. the geometric characteristics of the ferrite vary as a function of the magnetic induction.

In order to overcome this difficulty, we proposed in the French patent application no. 87 15202, filed on 3rd Nov. 1987, in the name of the Applicant, to place in the gap between the inner arms a material of the silicone family. Although this material has given satisfactory results for fixed frequencies, this not the case when the transformer has to operate at variable frequencies and the present invention overcomes this deficiency. In addition, the silicones which must be used are neutral silicones, which have the disadvantage of being only poorly adherent.

SUMMARY OF THE INVENTION

The aim of the present invention is therefore to overcome these difficulties by proposing a new material.

As a consequence, the object of the present invention is a transformer of the ferrite closed magnetic circuit type with an air gap, characterised by the fact that the air gap is filled with a single-component mastic having a Shore hardness which is essentially temperature independent over the normal temperature range of operation. Preferentially, the mastic has a Shore hardness of 30° at 25° C.

In a preferred embodiment of the invention, the single-component mastic is selected from the polysulphide or polyurethane mastics. The mastic used is preferentially a polysulphide mastic.

Single-component mastics such as polysulphide or polyurethane mastics have the advantage of being self-adherent, sufficiently flexible to cushion the vibrations and also of curing without shrinkage with time.

BRIEF DESCRIPTION OF THE DRAWINGS

Other characteristics and advantages of the present invention will appear on reading the description below of a preferred embodiment taken as a non-restrictive example and illustrated by the drawing in the appendix in which.

DESCRIPTION OF A PREFERRED EMBODIMENT

Figure 1:
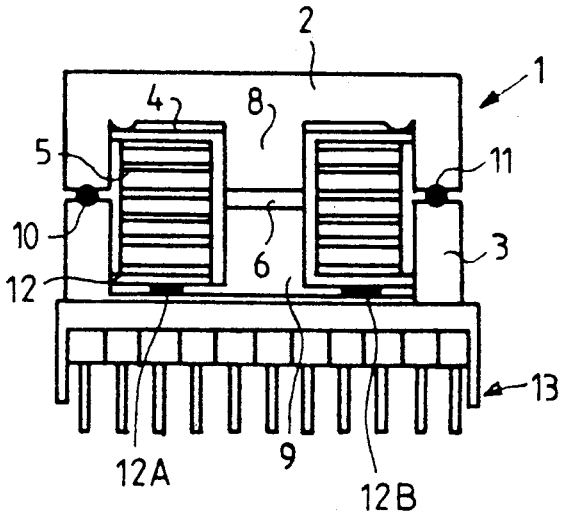
FIG. 1 is a section view of a transformer with a magnetic circuit in the shape of a double "E" constructed using the normal technique.

As represented in FIG. 1, a transformer 1 for switching power supplies includes a magnetic circuit composed of two ferrite half-circuits 2, 3 having in section the shape of an "E" . The lower magnetic half-circuit 3 has an inner or central arm 9 which is shorter than the two outer arms. The transformer 1 also includes a winding support 4. This support carries a coil 5 which has one or more electrically separated windings. The magnetic circuit and the winding support are assembled by glueing, as explained below. The magnetic circuit is stuck to the support 4 by placing glue on the external face of a side 12 of the support 4. This side 12 is the one on the side of the lower magnetic half-circuit 3 and of the base 13 where the transformer is fixed and the coils are electrically connected. The dabs of gule 12A and 12B thus enable the magnetic circuit 3 and the support 4 to be joined. Then, dabs of glue are placed in the spaces 10, 11 between opposing faces of the outer arms of the magnetic circuits 2, 3 in such a way as to fix together the two magnetic circuits. In this case, the gap 6 between the inner arms 8, 9 is then of air. This type of air gap absorbs the mechanical stresses due to thermal shock. Thus there is no longer any risk of fissuring of the ferrites. However, this air gap generates magnetostriction nosies which give a particularly annoying humming sound.

Figure 2:
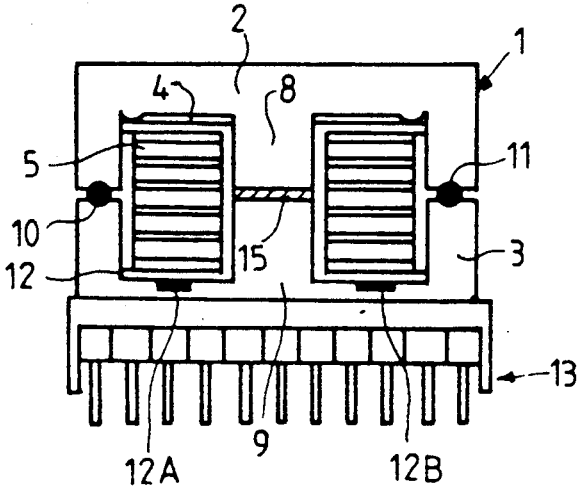
FIG. 2 is a section view of a transformer of the same type as that shown in FIG. 1, constructed in accordance with the invention.

In accordance with the present invention and to diminish considerably these magnetostriction noises, the gap determined by the arms 8 and 9 is filled with an absorbent material 15 as shown in FIG. 2. This material 15 is a single-component mastic having a Shore hardness of about 30° ShA at 25° C. This Shore hardness in additional behaves contantly as a function of temperature. In fact, the single-component mastic is selected among the polysulphide or polyurethane mastics. Preferably a polysulphide mastic is used, which has at present the advantage of being more flexible than polyurethane mastics. The polysulphide mastic also has the advantage of being a good dissipator of heat, which enables the heat generated at the gap to be discharged more efficiently than with an air-filled gap.

As an example, we used as a polysulphide mastic the mastic sold by CIBA-GEIGY under the name of ARA joint PRC. This mastic was placed in a gap 0.8 mm wide in the form of a thick drop weighing 0.4 to 0.7 g. This type of mastic has the advantage that it cures without noticable shrinkage with time. This paste was put in place before the two magnetic half-circuits 2 were assembled by the glue dabs 10 and 11, as in FIG. 1.

What is claimed is:

1. A transformer comprising a ferrite closed magnetic circuit including a gap in the circuit and a winding support carrying at least one electrically separated coil, wherein the gap is filled with with a single component mastic selected from the group consisting of polysulfides and polyurethanes.

2. A transformer comprising:

a magnetic circuit composed of a ferrite;

said ferrite having at least one section including a gap;

at least one electrically isolated winding disposed around said section of said ferrite; and a single component mastic selected from the group consisting of polysulfides and polyurethanes essentially filling said gap.

3. A transformer, as recited in claim 2, wherein said magnetic circuit comprises:

an upper ferrite half-circuit and a lower ferrite half-circuit;

each of said half-circuits having, in section, the shape of the letter "E" with one inner arm and two outer arms;

wherein said outer arms have equal lengths which are greater than the length of at least one of said inner arms;

said outer arms of said upper half-circuit are facing and connected to said outer arms of said lower half-circuit;

said windings disposed around said inner arms; and said single component mastic essentially filling said gap between said inner arms.

* * * * *